US006540080B2

(12) United States Patent
Moreyra

(10) Patent No.: US 6,540,080 B2
(45) **Date of Patent: *Apr. 1, 2003**

(54) PROTECTIVE WRAP FOR PROTECTING AND PACKAGING AND METHOD FOR PRODUCING SAME

(76) Inventor: Albert Moreyra, 2504 Katina Dr., Flower Mound, TX (US) 75028

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/371,418

(22) Filed: Aug. 10, 1999

(65) Prior Publication Data

US 2001/0002004 A1 May 24, 2001

(51) Int. Cl.[7] ..... B65D 81/02
(52) U.S. Cl. ..... 206/523; 206/586; 206/591
(58) Field of Search ..... 206/523, 586, 206/591, 592, 453; 53/139.7; 248/345.1

(56) References Cited

U.S. PATENT DOCUMENTS 3,035,825 A * 5/1962 Weller ..... 206/523
3,725,188 A * 4/1973 Kalt ..... 206/523
3,948,436 A * 4/1976 Bambara ..... 206/523
4,784,269 A * 11/1988 Griffith ..... 206/453
4,851,286 A * 7/1989 Maurice ..... 206/523
4,865,201 A * 9/1989 Liebel ..... 206/586
5,226,557 A * 7/1993 Nelson ..... 206/523
5,950,835 A * 9/1999 Moser et al. ..... 206/586
6,006,905 A * 12/1999 Campbell, Jr. ..... 206/586

* cited by examiner

*Primary Examiner*—Shian Luong

(57) ABSTRACT

A protective wrap is disclosed that includes a single solution to protecting rigid angled products that require vertical and horizontal strength of interior forms or posts as well as a resilient cushioning property of a flexible poly-based based product to prevent damage upon impact from mechanical or manual handling. Many applications will benefit from the opportunity to reduce costs through a reduction in packing materials and in downgrading the corrugated construction or eliminate the exterior protection of corrugated boxes. The protective wrap includes at least one layer poly-based material, such as of a closed or open cell foam secured between laminated layers of paper or, alternatively, laminated to one layer of laminated paper with the flexible poly-based material exposed. The protective wrap is formed to a rigid right angle, a C-channel, or any angled shape.

1 Claim, 5 Drawing Sheets

PROTECTIVE WRAP FOR PROTECTING AND PACKAGING AND METHOD FOR PRODUCING SAME

BACKGROUND

The present invention relates to packaging materials and, more specifically, to A protective wrap using in securing, handling, packaging, or shipping that combines paper and poly-based products.

In the packaging and shipping industry, packaging materials typically serve to protect during securing, shipping, and handling. Packaging materials made to provide edge protection, stacking stability, and/or cushioning support during securing, shipping, and handling, such as corrugated pads, open or closed cell foam, cores and molded foam or papers, lack a cost effective combination of providing both the compression strength and crush resilience typically required for providing support during shipping and handling of heavy appliances and furniture.

For example, as shown in FIG. 1A, a corrugated piece 10 is made of corrugated cardboard having an inner wall 11 and an outer wall 12 that enclosed corrugates spacing portions 13 separated by a middle wall 14.

On the other hand, packaging materials designed to provide a high level of longitudinal compression strength required for support during stacking, such as pressed paper formed into various shapes, lack the necessary cushioning needed to protect the appliance against clamping or handling pressure applied when shipping or handling heavy packages used with non-corrugated exterior protection.

For example, as shown in FIG. 2A, a laminated packing piece 16 having several layers of paper sheets 17*a*, 17*b*, and 17*c* laminated or glued together to form an inner wall 17*d* and an outer wall 17*e*.

Accordingly, what is needed is a protective wrap for providing the required vertical and horizontal strength as well as resilient cushioning to prevent damage due to shipping, packing, and/or handling and a cost effective method for producing same.

SUMMARY

Therefore, a protective wrap is provided, as well as a method for making same, that includes a single solution to protecting rigid angled products that require vertical and horizontal strength of interior forms or posts as well as a resilient cushioning property to prevent damage upon impact from mechanical or manual handling. Many applications will benefit from the opportunity to reduce costs through a reduction in packing materials and in downgrading the corrugated construction or eliminate the exterior protection of corrugated boxes. The protective wrap features at least one layer of a closed or open cell foam laminated in between laminated layers of paper or laminated to the exterior part of the paper with the foam exposed and formed to a rigid right angle, a C-channel, or any angled shape.

DETAILED DESCRIPTION

Figure 1A:
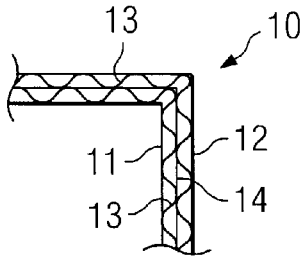
FIG. 1A (PRIOR ART)
FIGS. 1A–1G and 2A–2F show prior art packaging material with high longitudinal compression strength needed for packaging, shipping, or securing, especially when stacking is required and prior art packaging material with high wall compression protection needed for protecting an appliance during packaging, shipping, or securing.
Figure 1B:
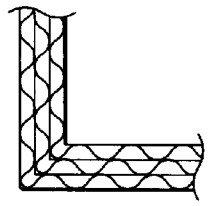
FIG. 1B (PRIOR ART)
Figure 1C:
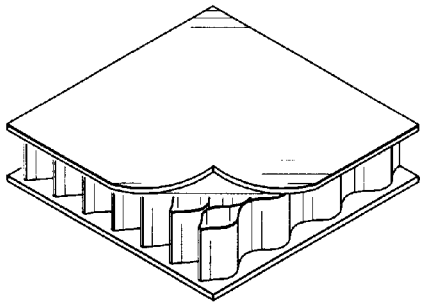
FIG. 1C (PRIOR ART)
Figure 1D:
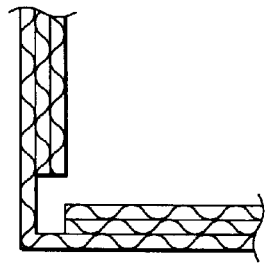
FIG. 1D (PRIOR ART)
Figure 1E:
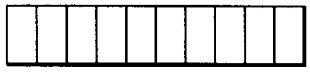
FIG. 1E (PRIOR ART)
Figure 1F:
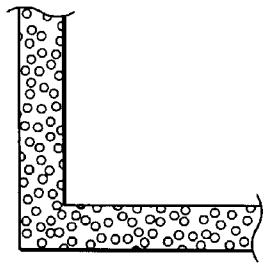
FIG. 1F (PRIOR ART)
Figure 1G:
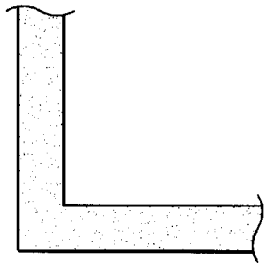
FIG. 1G (PRIOR ART)
Figure 2A:
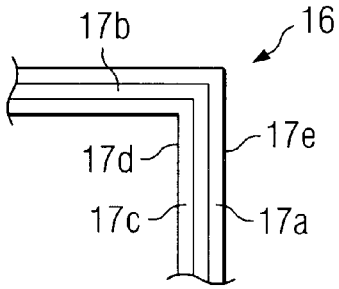
FIG. 2A (PRIOR ART)
Figure 2B:
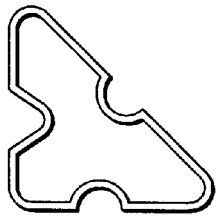
FIG. 2B (PRIOR ART)
Figure 2C:
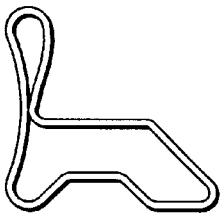
FIG. 2C (PRIOR ART)
Figure 2D:
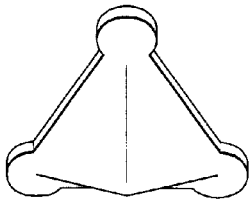
FIG. 2D (PRIOR ART)
Figure 2F:
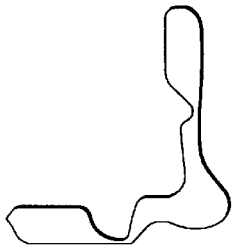
FIG. 2F (PRIOR ART)
Figure 2E:
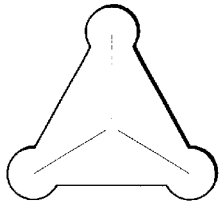
FIG. 2E (PRIOR ART)
Figure 3:
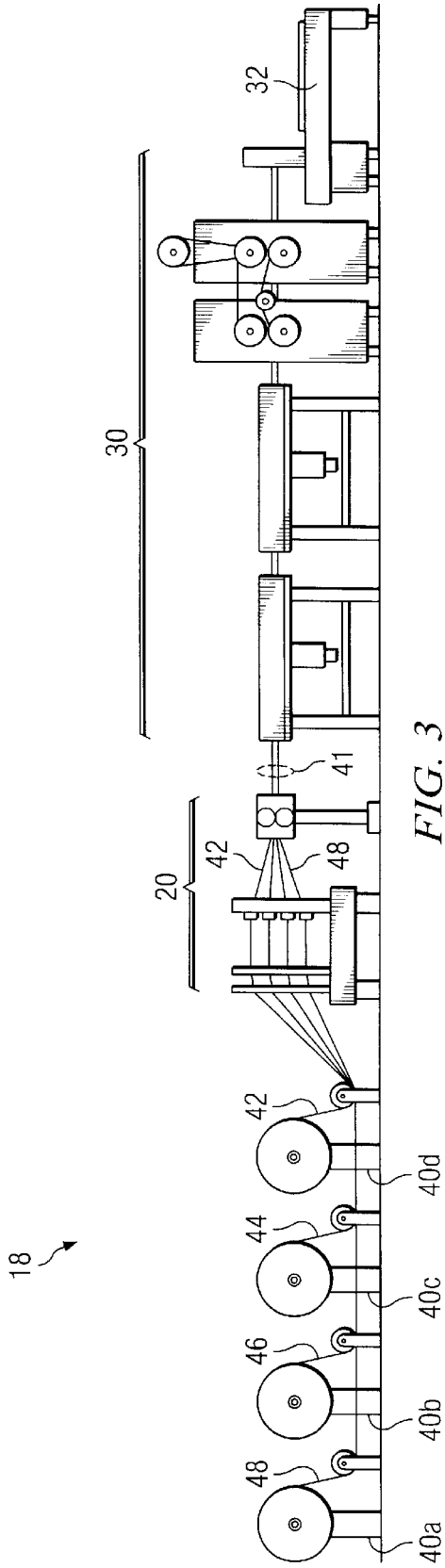
FIG. 3 illustrates a system for preparing protective wraps in accordance with the teaching of the present invention.

Referring to FIG. 3, a system 18 is shown having a gluing unit 20, such as that supplied or custom built by Cee Corp., and a shaping unit 30, such as those supplied or custom built by Cee Corp. Although these units are shown as generic units or a specific manufacturer's equipment is identified, it is evident to those skilled in the art that a variety of units are available for performing the function described in association with each unit. A plurality of supports 40*a*, 40*b*, 40*c*, and 40*d* are shown, each supporting a roll containing a specific type of material, which has a specific thickness, that feeds the unit 20. The strands of materials being fed into the unit 20 from the supports 40 are either paper based or paper-and-poly based materials. For clarity and simplicity, only four supports are shown, feeding four strands of product into the unit 20 and the four strands are glued or "laminated" together to form a composite strand 41; however, any number of supports can be used and, thus, any number of strands can feed the unit 20 thereby forming composite strands of varying thickness.

The thickness of each strand is identified in "caliper" units. The thickness of the each strand of material wound onto each roll is varied depending on the design criteria. Therefore, the thickness of the composite material 41 can be altered as needed by varying the thickness of each strand. Also, as the thickness of each strand is varied, so is the performance of the resulting product as well as the size and weight. For example, each paper strand can vary from 0.050 caliper to 0.500 caliper in thickness. Accordingly, the thickness of each strand in conjunction with the number of strands determines the performance criteria of the resulting product.

As strands 42–48 enter the unit 20, the strands 42–48 are coated with a glue or adhesive substance on one or both faces depending on the design parameters as well as the relative position of each strand in the composite material 41. For example, strand 42 entering the unit 20 may be coated with glue only on the downward facing side while strands 44 and 46 may be coated with glue on both sides with strand 48 being coated with glue on the upward facing side.

In accordance with the teachings of the present invention, at least one of the strands 42–48 is composed of a paper-poly or a poly-type based material. The poly-based portion can be made of polyurethane foam, polyethylene foam, PVC or expanded foam, anti-static polyethylene foam, cross linked polyethylene, and a variety of other closed or open cell foam products. For example, strand 48 may be a paper-poly based product such and laminated-foam paper sold by Tenneco (AVI) Inc.; Sealed Air, Inc; Poly Air Co.; and/or FP Int'l Inc.

Furthermore and in accordance with another teaching of the present invention, more that one composite strand can emerge from unit 20. For example, if strands 42 and 44 are laminated together to form one composite strand and strands 46 and 48 are laminated together to form a second composite strand, then there would be two independent composite strands emerging from the unit 20. As additional supports and rollers are used to feed the unit 20 (not shown) then additional composite strands or thicker composite strands can be created as needed with varying performance properties. This is achieved by controlling the surface or sides of each strand that is coated with the glue upon passing through the unit 20. Thus, if glue is not applied to the side of strand 44 adjacent the side of strand 46 and vise-versa, then two independent composite strands would be simultaneously created because strand 44 and 46 would not be laminated together.

As indicated above, at least one strand would be made from a poly-based material. Typically, several composite strands emerge simultaneously from the unit 20 as a stack of composite strands. Preferably, the poly-based strand of one composite strand is located adjacent a second composite strand as the stack of composite strands enter the shaping unit 30.

Figure 4:
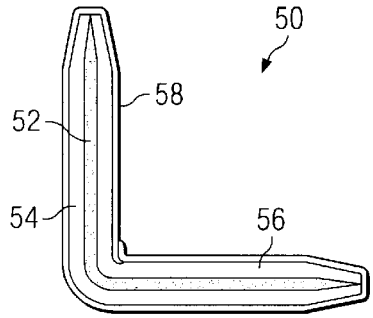
FIG. 4 shows a top elevation of one embodiment of a protective wrap in accordance with the present invention.
Figure 9:
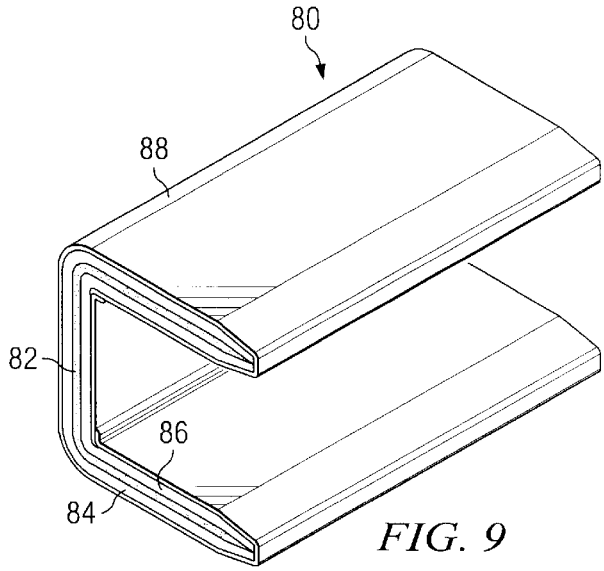
FIG. 9 is a perspective elevation of the protective wrap of FIG. 8.
Figure 11:
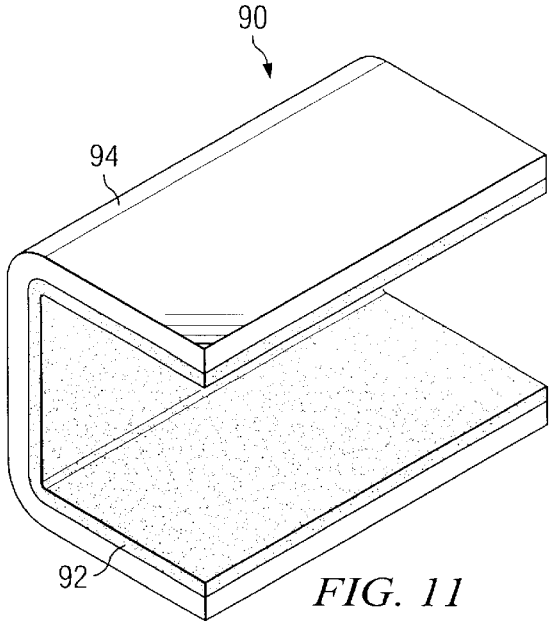
FIG. 11 is a perspective elevation of the protective wrap of FIG. 10.

As the stack of composite strands enter the unit 30, the composite strands are bent or formed into the desired shapes. For example, the stack of composite strands could be shaped in the form of a right-angle corner section or piece as shown in FIG. 4. The shapes created by the unit 30 are limited only by the limitation of the equipment utilized and the design parameters and not the intended scope of the present disclosure. Alternatively, the stack of composite strands could be shaped into a C-channel, as indicated in FIGS. 9 and 11. Upon emerging from the unit 20, a cutting unit 32 cuts the composite strands to the desired length.

Figure 5:
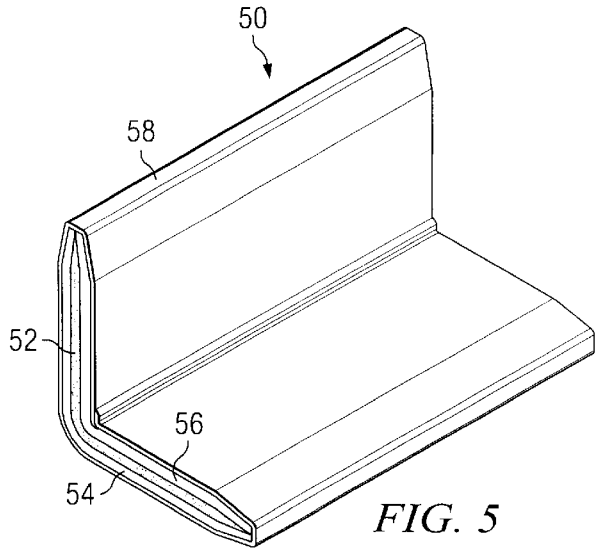
FIG. 5 is a perspective elevation of the protective wrap of FIG. 4.

Referring now to FIGS. 4 and 5, a shaped composite piece 50 of a desired length includes a poly-portion 52 and laminated paper portions 54 and 56. The laminated paper portions 54 and 56 are then wrapped for aesthetic and structural reason using a wrapping material 58, such as litho paper Kraft liner poly coated or non-coated paper. Alternatively, the composite piece could be utilized without being wrapped (not shown) by wrapping material 58, similar that shown in FIG. 6.

Figure 6:
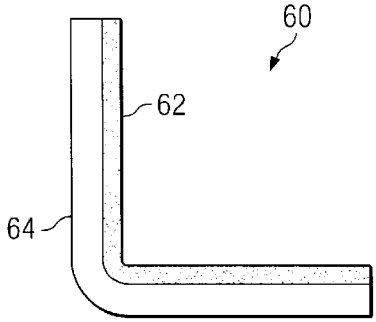
FIG. 6 shows a top elevation of another embodiment of a protective wrap in accordance with the teachings of the present invention.
Figure 7:
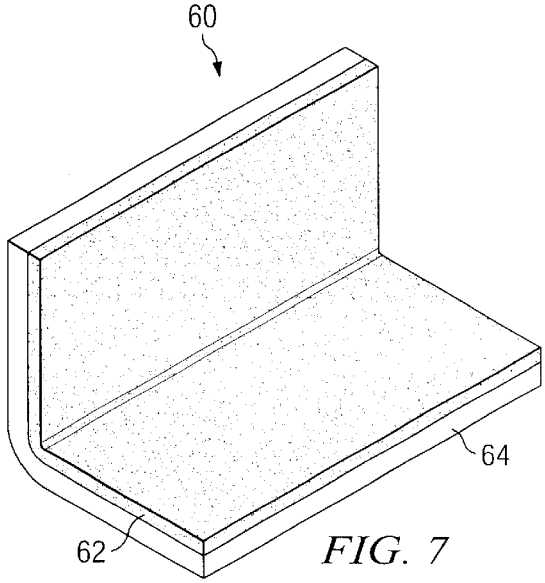
FIG. 7 is a perspective elevation of the protective wrap of FIG. 6.

Referring now to FIGS. 6 and 7, in an alternative embodiment a shaped composite piece 60 is shown having a poly-based portion 62 and a laminated paper portion 64. In this embodiment the poly-based portion 62 is exposed on the contact side of the piece 60 for additional protection as the piece 60 comes into contact with furniture, which has a polished surface that would otherwise be scratched or damage if it were to come into contact with a more abrasive surface, such as paper.

Figure 8:
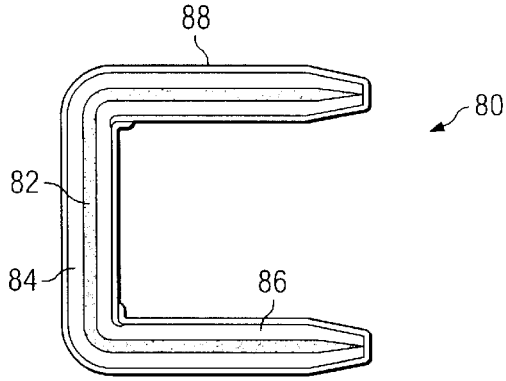
FIG. 8 shows a top elevation of another embodiment of a protective wrap in accordance with the present invention.

Referring now to FIGS. 8 and 9, in yet another embodiment, a C-channel shaped composite material 80 is shown, which is typically utilized in wrapping edges of furniture, doors, windows, and other similar products. The material 80 is shown having poly-based portion 82 and a laminated paper portions 84 and 86. The laminated paper portions 84 and 86 are then wrapped for aesthetic and structural reason using a wrapping material 88, such as litho paper Kraft liner poly coated or non-coated paper. Alternatively, the composite material 80 could be utilized without being wrapped (not shown) by wrapping material 88.

Figure 10:
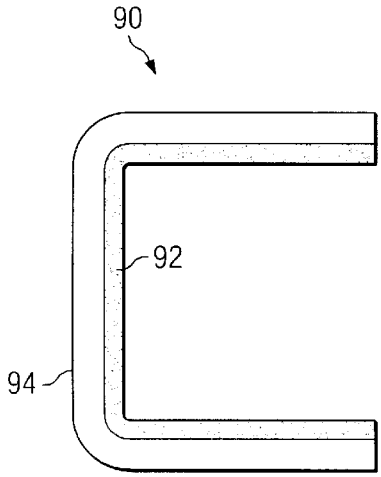
FIG. 10 shows a top elevation of yet another embodiment of a protective wrap in accordance with the teachings of the present invention.

Referring now to FIGS. 10 and 11, in yet another alternative embodiment a C-channel shaped composite piece 90 is shown having a poly-based portion 92 and a laminated paper portion 94. In this embodiment the poly-based portion 92 is exposed on the side of the piece 90 that comes into contact with the product being packaged, such as the furniture, for additional protection. Thus, delicate or polished surfaces that would otherwise be scratched or damage by coming into contact with a more abrasive surface, such as paper, are protected.

Thus, having fully described the present invention by way of example with reference to attached drawing figures, it will be readily appreciated that many changes and modifications may be made to the invention and to any of the exemplary embodiments shown and/or described herein without departing from the spirit or scope of the invention, which is defined in the appended claims. For example, although it is noted that the composite strands are first shaped and then cut, it is possible to cut the composite strands to a desired length and then shaped the strands into a desired shape.

What is claimed is:

1. A protective wrap for providing increase compression and support strength used in packaging, securing, handling, or shipping applications, the protective wrap comprising:

a first plurality of paper sheets laminatingly compressed to form an outside wall having an outside and an inside surface;

a flexible poly-based layer secured to the inside surface of the outside wall, wherein the flexible poly-based layer includes at least one sheet secured to one surface of the flexible poly-based layer; and a second plurality of sheets laminatingly compressed to form an inside wall having an outside and an inside surface, wherein the outside surface of the inside wall is positioned at an opposite side of the foam.

* * * * *